US007880089B1

(12) United States Patent
Herrin

(10) Patent No.: US 7,880,089 B1
(45) Date of Patent: Feb. 1, 2011

(54) METAL-CLAD CABLE ASSEMBLY

(75) Inventor: Jeffrey D. Herrin, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 0 days.

(21) Appl. No.: 12/139,249

(22) Filed: Jun. 13, 2008

(51) Int. Cl.
*H01B 7/00* (2006.01)

(52) U.S. Cl. ..... 174/113 R

(58) Field of Classification Search ..... 174/113 R, 174/102 R, 102 D, 116
See application file for complete search history.

(56) References Cited

U.S. PATENT DOCUMENTS

| | | | | |
|---|---|---|---|---|
| 1,687,013 | A | 10/1928 | Frederickson | |
| 1,788,483 | A | 1/1931 | Frederickson | |
| 1,995,407 | A | 3/1935 | Walker | |
| 2,258,687 | A | 10/1941 | Peterson | |
| 2,308,274 | A | 1/1943 | Frederickson | |
| 2,866,843 | A | 12/1958 | Arman | |
| 3,023,267 | A | 2/1962 | Rubinstein et al. | |
| 3,032,604 | A | 5/1962 | Timmons | |
| 3,600,500 | A | 8/1971 | Schoerner et al. | |
| 3,660,592 | A | 5/1972 | Anderson | |
| 3,673,315 | A | 6/1972 | Lasley | |
| 3,829,603 | A | 8/1974 | Hansen et al. | |
| 4,081,602 | A | 3/1978 | Paniri et al. | |
| 4,368,350 | A | 1/1983 | Perelman | |
| 4,368,613 | A | 1/1983 | Sanchez | |
| 4,374,299 | A | 2/1983 | Kincaid | |
| 4,510,346 | A * | 4/1985 | Bursh et al. | 174/36 |
| 4,956,523 | A | 9/1990 | Pawluk | |
| 5,191,173 | A | 3/1993 | Sizer et al. | |
| 5,192,834 | A | 3/1993 | Yamanishi et al. | |
| 5,212,350 | A | 5/1993 | Gebs | |
| 5,218,167 | A | 6/1993 | Gasque, Jr. | |
| 5,329,065 | A | 7/1994 | Marney et al. | |
| 5,350,885 | A | 9/1994 | Falciglia et al. | |
| 5,416,268 | A | 5/1995 | Ellis | |
| 5,939,668 | A | 8/1999 | De Win | |
| 6,259,019 | B1 | 7/2001 | Damilo et al. | |
| 6,310,295 | B1 | 10/2001 | Despard | |
| 6,486,395 | B1 | 11/2002 | Temblador | |

(Continued)

FOREIGN PATENT DOCUMENTS

| | | |
|---|---|---|
| CA | 525826 | 6/1956 |

(Continued)

OTHER PUBLICATIONS

Underwriters Laboratories Inc., UL4, Standard for Safety, Armored Cable, Nov. 4, 1998.

(Continued)

*Primary Examiner*—Chau N Nguyen
(74) *Attorney, Agent, or Firm*—Gardere Wynne Sewell LLP

(57) ABSTRACT

A metal-clad cable assembly includes a conductor assembly having at least two conductors and a binder disposed around the at least two conductors. The cable assembly also includes a bare grounding conductor disposed externally to the conductor assembly and at least partially within at least one interstice formed between the at least two conductors. A metal sheath is disposed around the conductor assembly and the bare grounding conductor. The binder exerts a force on the bare grounding conductor to position the bare grounding conductor against an interior surface of the metal sheath.

2 Claims, 2 Drawing Sheets

U.S. PATENT DOCUMENTS

| | | | | |
|---|---|---|---|---|
| 6,566,606 | B1 | 5/2003 | Hazy et al. | |
| 6,624,358 | B2 | 9/2003 | Krabec et al. | |
| 6,906,264 | B1 | 6/2005 | Grant, Jr. et al. | |
| 7,309,835 | B2 | 12/2007 | Morrison et al. | |
| 7,432,446 | B2 * | 10/2008 | Orfin et al. ..... | 174/113 R |
| 7,754,969 | B2 | 7/2010 | Kummer et al. | |

FOREIGN PATENT DOCUMENTS

| | | |
|---|---|---|
| DE | 1075181 | 2/1960 |
| DE | 19719410 | 11/1997 |
| FR | 2762438 | 10/1998 |
| GB | 351881 | 7/1931 |
| JP | 54014138 | 2/1979 |
| JP | 5028845 | 2/1993 |
| JP | 6096618 | 4/1994 |
| JP | 11232934 | 8/1999 |

OTHER PUBLICATIONS

Underwriters Laboratories Inc., UL 1569, Metal-Clad Cables, May 25, 2005.

National File Protection Association, NFPA 70 National Electrical Code, 1999 Edition, Article 100, 250, 333, 334, 517.

Underwriters Laboratories, Inc., UL 1569 Metal-Clad Cables, Oct. 10, 2005.

International Search Report Dated Sep. 10, 2008 issued in Application No. PCT/US2008/063846.

Carmin J. Scotti, Literature Search Report, Dec. 19, 2005, 38 pages.

David Johnson, Search Report, Apr. 13, 2005, 12 pages.

Powers, Jr., The Basics of Power Cable, Cement Industry Technical Conference, 1994. XXXVI Conference Record, 36th IEEE, pp. 37-45 , (May 29-Jun. 2, 1994).

Hartwell, Abstract: Wiring Methods for Patient Care Areas, EC & M: Electrical Construction and Maintenance, vol. 93(4), pp. 82-83, Elsevier, Inc. (2008).

Jenks et al, Performance of Bare Aluminum Wire as Armoring Material for Submarine Cables, IEEE Transactions on Power Apparatus and Systems, vol. 82(66), pp. 379-382 (Jun. 1963).

Temblador, New Form of Type MC Cable Crosses Application Boundaries, IAEI News, pp. 83-89, Sep.-Oct. 2006.

Office Action dated Apr. 3, 2009 in U.S. Appl. No. 12/046,488.

* cited by examiner

METAL-CLAD CABLE ASSEMBLY

BACKGROUND

Metal-clad cables having an interlocked metal sheath potentially provide a low impedance and reliable ground path in order to function as an equipment grounding conductor. Once type of such cable described in U.S. Pat. No. 6,486,395, assigned to the assignee of the present invention, contains a conductor assembly having at least two electrically insulated conductors cabled together longitudinally into a twisted bundle and enclosed within a binder/cover. A bare grounding conductor is cabled externally over the binder/cover, preferably within a trough/interstice formed between the insulated conductors. The metal sheath is helically applied to form an interlocked armor sheath around the conductor assembly, and the bare grounding conductor is adapted to contact the sheath to provide the low impedance ground path.

This design provides significant advantages over other metal clad cables not so constructed. In order to maximize its utility and lowest impedance ground path, it is important that adequate contact be maintained between the bare grounding conductor and the interior surface of the metal sheath. This is particularly challenging due to differing wire gauges that may occur between the insulated conductors and the bare grounding conductor. For example, in the event the insulated conductors comprise a low wire gauge (e.g., large diameters) forming a large interstice to receive a bare grounding conductor with a high wire gauge (e.g., a smaller diameter), the desired maximum contact between the bare grounding conductor and the metal sheath may not be achieved due to the bare grounding conductor resting too far within the interstice. One solution is to provide fillers to at least partially fill an interstice and "lift" the bare grounding conductor from within the interstice; however, providing such fillers can, among other things, be costly, labor intensive and unnecessarily increase the overall weight and/or decrease the overall flexibility of the metal-clad cable.

SUMMARY

In accordance with one aspect of the present invention, a metal-clad cable assembly is provided including a conductor assembly having at least two insulated conductors lying adjacent one another, in a non-twisted manner, and a binder member, for instance, a non-conductive binder member, disposed around the insulated conductors. The cable assembly further includes a bare grounding conductor disposed externally to the conductor assembly and at least partially within an interstice formed between adjacent insulated conductors. An outer metal sheath surrounds the conductor assembly and bare grounding conductor. According to some embodiments, the binder is of a sufficient resiliency to exert an outward radial force on the bare grounding conductor to maximize the positioning of the bare grounding conductor against, and in firm contact with, the interior surface of the metal sheath.

In accordance with another aspect of the present invention, a method of manufacturing a metal-clad cable assembly is provided. According to some embodiments, the method comprises wrapping a resilient binder around at least two non-twisted conductors forming the conductor assembly, and placing a bare grounding conductor within the interstice formed between the two conductors of the conductor assembly. The method further comprises disposing a metal sheath around the conductor assembly and a bare grounding conductor to form a low impedance ground path, with the binder exerting a force on the bare grounding conductor to position it against and maximize contact with the interior surface of the metal sheath.

DETAILED DESCRIPTION

Figure 1:
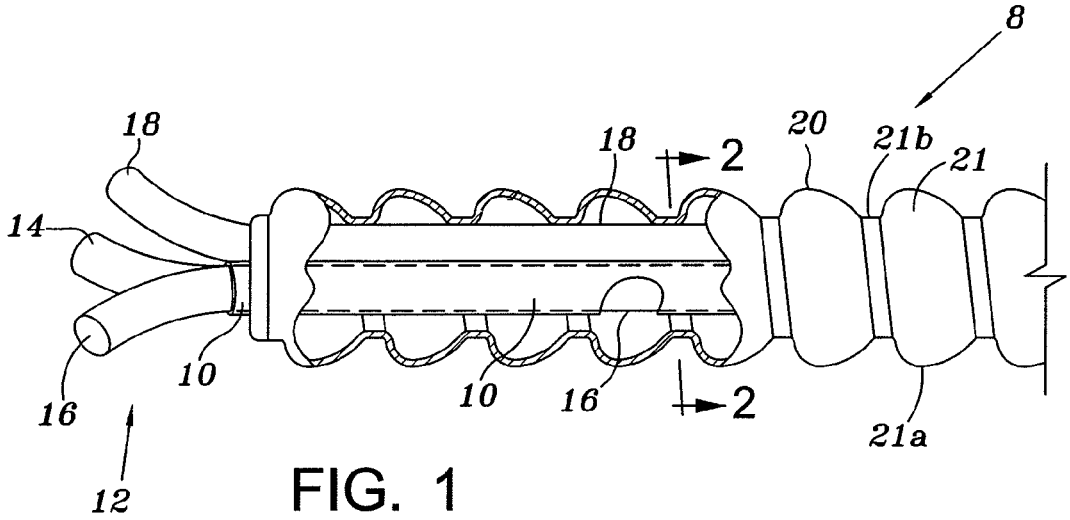
FIG. 1 is an illustration of a partial cut-away side view of an embodiment of a metal-clad cable assembly in which a resilient binder is employed to advantage.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

Figure 2:
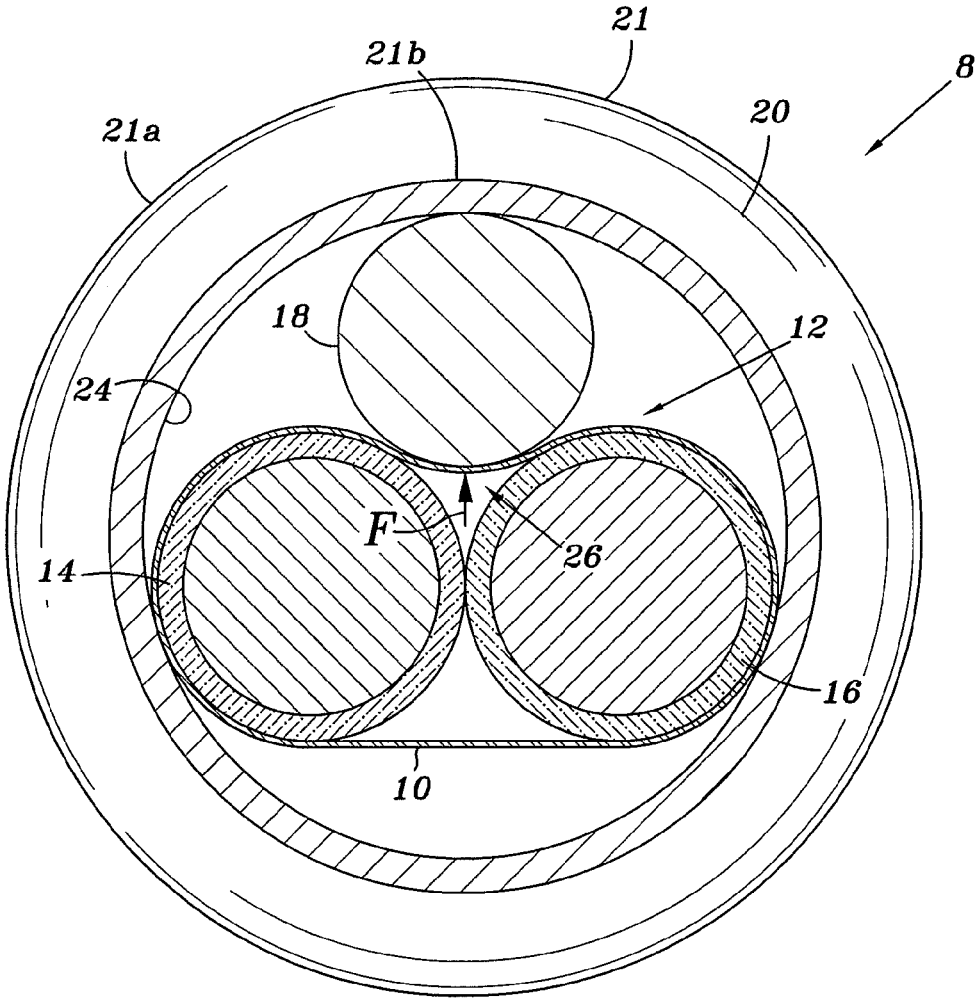
FIG. 2 is a section view of the metal-clad cable assembly taken along the line 2-2 of FIG. 1.

Referring initially to FIGS. 1 and 2, an embodiment of a metal-clad cable assembly 8 comprises a conductor assembly 12 comprising at least two insulated conductors 14 and 16 disposed within a resilient binder 10. A bare grounding conductor 18, such as, for example, a bare aluminum wire, is externally disposed with respect to binder 10 and adjacent to the conductor assembly 12. It should be understood that while two insulated conductors 14 and 16 and one bare grounding conductor 18 are illustrated, a greater number of insulated conductors and a greater number of bare grounding conductors may be utilized, depending on the particular application of the metal-clad cable assembly 8.

In the embodiment illustrated in FIGS. 1 and 2, conductor assembly 12 and bare grounding conductor 18 are disposed within a metal sheath 20 with the engagement of the bare grounding conductor 18 with the metal sheath 20 providing a low impedance ground path having an ohmic resistance equal to or lower than the ohmic resistance requirements necessary to qualify as an equipment grounding conductor under, for example, Underwriters Laboratory Standard for Safety for Metal-Clad Cables UL 1569 (hereinafter "UL 1569"). According to a particular feature of this assembly, metal sheath 20 is formed of a metal strip having overlapping and interlocking adjacent helical convolutions, an example of which is described in U.S. Pat. No. 6,906,264, assigned to the assignee of the present invention, the disclosure of which is incorporated by reference herein. For example, as best illustrated in FIG. 1, metal sheath 20 is formed of a metal strip such as, for example, aluminum, having convolutions 21 that overlap or interlock with uniformly spaced "crowns" 21*a* and "valleys" 21*b* defining the outer surface of the sheath. However, it should be understood that metal sheath 20 may be otherwise configured, such as, for example, a solid or non-interlocked metallic covering.

Conductors 14 and 16 are held together by binder 10 that extends the length of cable assembly 8 (FIG. 1) tensioned and/or otherwise wrapped around conductors 14 and 16 to prevent relative movement therebetween (FIG. 2). As illustrated in FIG. 2, binder 10 is of sufficient resiliency and otherwise tensioned to provide an outward radial force F against bare grounding conductor 18, thus facilitating the engagement of the grounding conductor 18 with the interior surface of the valleys 21*b* of the metal sheath 20 (e.g., the inner curves of the convolutions 21), while also preventing and/or substantially reducing relative movement between conductors 14 and 16. As a feature of this invention, the bare grounding conductor 18 is disposed adjacent the conductor assembly 12 within a trough or interstice 26 formed between insulated conductors 14 and 16. Binder 10 is of a sufficient resiliency to lift and/or otherwise move bare grounding conductor 18 away from within interstice 26, thereby to maximize contact with the interior surface 24 of the cable 20.

Binder 10 may be formed of a nonmetallic and non-conductive band of material, such as, but not limited to, polyester (Mylar) or polypropylene. However, binder 10 may alternatively be formed of any other suitable conductive or non-conductive material, such as, for example, rubber, string or metal. The binder may be helically wound to provide the necessary resilience to maintain bare grounding conductor 18 in contact with the interior surface 24 of metal sheath 20, substantially along the length thereof.

While conductors 14 and 16 are illustrated in FIGS. 1 and 2 in a non-twisted orientation, these conductors may alternatively be configured in a twisted orientation, enclosed by binder 10, with bare grounding conductor 18 disposed externally thereof and within interstice 26. Moreover, bare grounding conductor 18 may be helically wound around the conductor assembly 12 such that bare grounding conductor is disposed outside of interstice 26. Furthermore, it should be understood that while conductors 14 and 16 are illustrated as having diameters of equal lengths, the diameters of conductors 14 and 16 may comprise diameters of differing lengths.

The configuration described above, and as illustrated in FIGS. 1 and 2, is particularly advantageous when conductors 14 and 16 have a low gauge (e.g., large diameters), thereby forming a large interstice 26 and/or when bare grounding conductor 18 has a high gauge (e.g., a small diameter) such that binder 10 generates the radially outward force F to lift and/or otherwise move bare grounding conductor 18 away from the interstice 26. For example, in particular applications in which each of the at least two conductors comprise a wire gauge equal to or less than about 10 AWG (e.g., a wire gauge of 10 AWG, 9, 8, 7, etc.) forming a large interstice and the bare grounding conductor comprises a wire gauge equal to or greater than about 14 AWG (e.g., a wire gauge of 14 AWG, 15, 16, 17, etc.), resilient binder 10 lifts bare grounding conductor 18 away from the interstice 26 to contact interior surface 24 of metal sheath 20. Thus, in the embodiment illustrated in FIGS. 1 and 2, resilient binder 10 maximizes the use of metal sheath 20 as a low impedance ground path by increasing contact between the bare grounding conductor 18 and the interior surface 24 of metal sheath 20, regardless of the wire gauge of conductors 14, 16 and/or 18.

Figure 3:
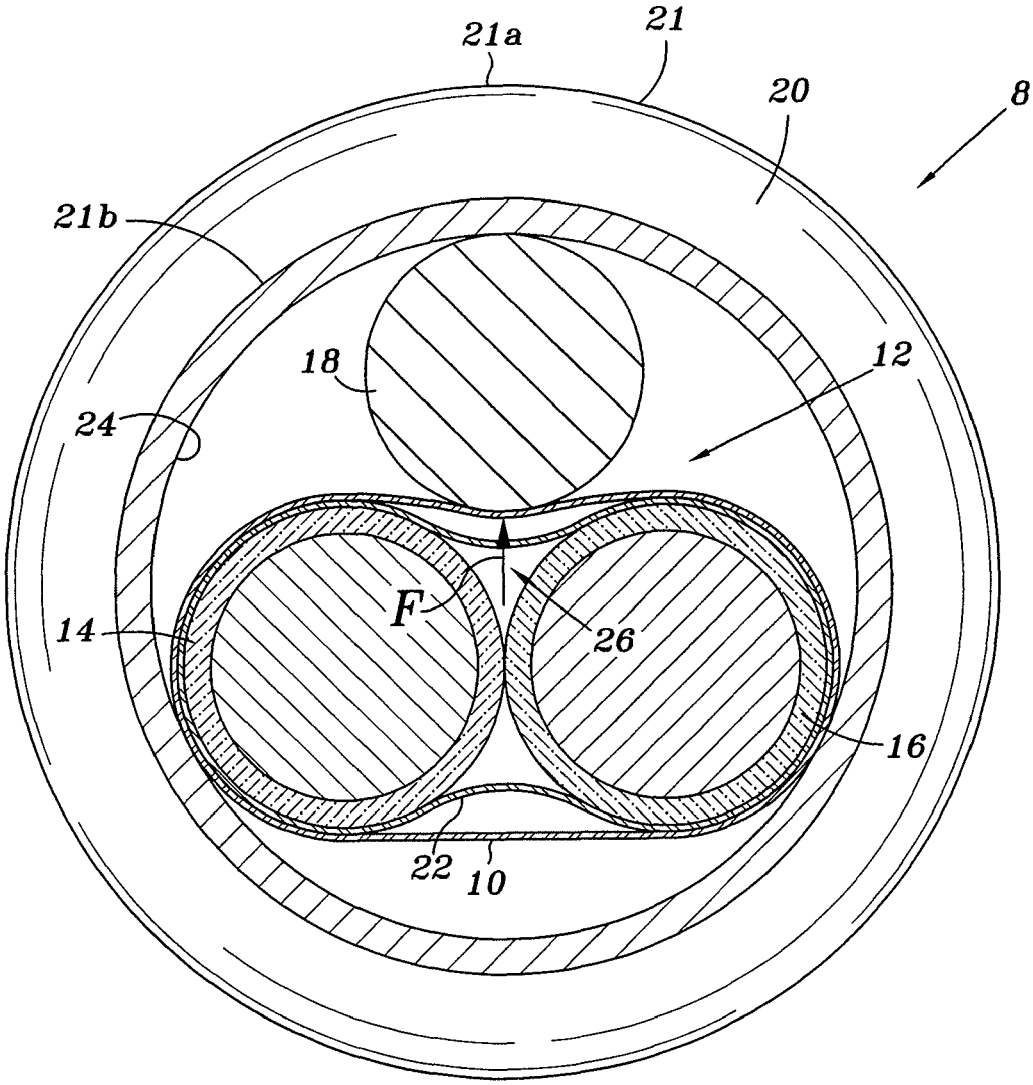
FIG. 3 is a section view of another embodiment of the metal-clad cable assembly of FIGS. 1 and 2.

In the embodiment illustrated in FIG. 3, a non-conductive binder or tape 22 is wrapped around the conductors 14 and 16 to prevent and/or substantially reduce relative movement between cables 14 and 16, while a separate resilient binder 10 is wrapped around conductors 14 and 16 and tape 22 to exert the outward radial force F on bare grounding conductor 18, to maximize contact of bare grounding conductor 18 with interior surface 24 of metal sheath 20. It should be understood that the binders 10 and 22 can be helically, tangentially or otherwise wrapped around conductors 14 and 16.

If desired, conductor assembly 12 may also comprise fillers (not illustrated) to at least partially fill interstice 26, the fillers and the resilient binder 10 thereby working together to maximize contact between bare grounding conductor 18 and the interior surface 24 of metal sheath 20.

When cabling the conductors 14 and 16, each conductor 14 and 16 is fed through a separate positioning hole in a lay plate or other device. Conductors 14 and 16 are then pulled together through an orifice into either a twisted or non-twisted bundle, depending on the desired configuration. Resilient binder 10 is then applied around the conductor bundle to complete conductor assembly 12.

Conductor assembly 12 and bare grounding conductor 18 are fed through a separate positioning hole in a lay plate or other device and then pulled together through an orifice, where the bare grounding conductor 18 is positioned externally against binder 10 of conductor assembly 12 and within interstice 26 formed between conductors 14 and 16. Bare grounding conductor 18 is cabled externally over conductor assembly 12 in concert with the cabling of the conductors 14 and 16.

Metal sheath 20 is then formed by using an armoring machine to helically wind the metal strip around conductor assembly 12 and bare grounding conductor 18. The edges of the helically wrapped metal sheath 20 interlock to form convolutions 21 along the length of cable 18. The inside perimeter of metal sheath 20 is sufficiently sized so that upon binder 10 exerting force F on bare grounding conductor 18, bare grounding conductor 18 engages the inner curves or "valleys" 21*b* of convolutions 21 in metal sheath 20 to form the low impedance ground path. The metal-clad cable assembly 8 may also be manufactured as described above by wrapping the binder or tape 22 around conductors 14 and 16 to prevent relative movement therebetween, and subsequently applying resilient binder 10 around conductors 14 and 16 and binder 22. Thus, construction of the cable assembly in accordance with the described embodiments enable resilient binder 10 to maximize the contact between the bare grounding conductor 18 and the interior surface 24 of metal sheath 20 along the longitudinal length of cable assembly 8, thus maximizing the use of metal sheath 20 as a low impedance ground path. It should be understood that manufacturing steps can be combined or executed simultaneously in a continuous manner and in any order.

Although embodiments of the metal clad cable assembly 8 have been described in detail, those skilled in the art will also recognize that various substitutions and modifications may be made without departing from the scope and spirit of the appended claims.

What is claimed is:

1. A metal-clad cable assembly, comprising:

a conductor assembly comprising at least two conductors disposed within a binder, the at least two conductors cabled together in a longitudinally non-twisted bundle under a conductive sheath forming an outermost layer of the cable assembly;

a bare grounding conductor cabled externally over the conductor assembly and disposed within an interstice formed between the at least two conductors; and the conductive sheath disposed over the conductor assembly, the conductive sheath and bare grounding conductor forming an equipment grounding path.

2. The cable of claim 1, wherein the binder is a non-conductive binder.

* * * * *